US007432499B2

(12) United States Patent
Edwards et al.

(10) Patent No.: US 7,432,499 B2
(45) Date of Patent: Oct. 7, 2008

(54) METHOD AND APPARATUS FOR DETECTING WHILE DRILLING UNDERBALANCED THE PRESENCE AND DEPTH OF WATER PRODUCED FROM THE FORMATION

(75) Inventors: John Edwards, Ruwi (OM); Christian Stoller, Princeton Junction, NJ (US); Peter Wraight, Princeton Junction, NJ (US); Roger Griffiths, Abu Dhabi (AE); Nicolas Renoux, Clamart Cedex (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 25 days.

(21) Appl. No.: 10/547,961

(22) PCT Filed: Mar. 3, 2004

(86) PCT No.: PCT/EP2004/002143

§ 371 (c)(1),
(2), (4) Date: Sep. 6, 2005

(87) PCT Pub. No.: WO2004/079161

PCT Pub. Date: Sep. 16, 2004

(65) Prior Publication Data

US 2006/0180754 A1 Aug. 17, 2006

(30) Foreign Application Priority Data

Mar. 7, 2003 (GB) ..... 0305249.5

(51) Int. Cl.
*G01V 5/04* (2006.01)
*G01V 5/06* (2006.01)

(52) U.S. Cl. ..... 250/259; 250/260

(58) Field of Classification Search ..... 250/259, 250/260

See application file for complete search history.

(56) References Cited

U.S. PATENT DOCUMENTS

| | | | | |
|---|---|---|---|---|
| 3,134,904 | A * | 5/1964 | Hubbard, Jr. et al. | 250/303 |
| 4,166,215 | A * | 8/1979 | Anderson | 250/260 |
| 4,233,508 | A | 11/1980 | Arnold | |
| 4,916,400 | A * | 4/1990 | Best et al. | 324/338 |
| 5,219,518 | A | 6/1993 | McKeon et al. | |
| 5,404,752 | A | 4/1995 | Chace et al. | |
| 5,543,617 | A | 8/1996 | Roscoe et al. | |
| 5,608,215 | A * | 3/1997 | Evans | 250/269.6 |
| 6,376,838 | B1 * | 4/2002 | Odom | 250/269.6 |
| 6,466,513 | B1 * | 10/2002 | Pabon et al. | 367/35 |
| 6,561,269 | B1 * | 5/2003 | Brown et al. | 166/77.1 |

(Continued)

OTHER PUBLICATIONS

Albertin I et al: "The Many Facets of Pulsed Neutron Cased-Hole Logging" Oilfield Review, Elsevier, Amsterdam, NL, vol. 8, N.R.2 pp. 28-41 XP008013790 ISSN: 0923-01730 p. 39-40.

*Primary Examiner*—David P. Porta
*Assistant Examiner*—Casey Bryant
(74) *Attorney, Agent, or Firm*—Darla Fonseca; Jaime Castano

(57) ABSTRACT

The invention relates to methods and apparatus for determining a downhole parameter in an underbalanced drilling environment which include: selectively activating a first fluid flowing from the formation through a wellbore while under balanced drilled; detecting the activated first fluid; and determining a depth at which said fluid enters the wellbore.

1 Claim, 3 Drawing Sheets

U.S. PATENT DOCUMENTS 6,807,486 B2 * 10/2004 Tobias et al. ..... 702/9
6,944,548 B2 * 9/2005 Radtke et al. ..... 702/8
2002/0134587 A1 * 9/2002 Rester et al. ..... 175/48
2005/0028586 A1 * 2/2005 Smits et al. ..... 73/152.14
2006/0254350 A1 * 11/2006 Wraight ..... 73/152.14

* cited by examiner

METHOD AND APPARATUS FOR DETECTING WHILE DRILLING UNDERBALANCED THE PRESENCE AND DEPTH OF WATER PRODUCED FROM THE FORMATION

BACKGROUND OF INVENTION

Formation properties while drilling or in a freshly drilled hole are measured to predict the presence of oil, gas and water in the formation. These formation properties may be logged with wireline tools, logging while drilling (LWD) tools, or measurement while drilling (MWD) tools. Measurements are usually performed open hole, with the wellbore containing fluid at a hydrostatic pressure in excess of the reservoir pressure, so the formation is not producing any fluid into the wellbore. Therefore in this case wellbore fluid measurements generally do not contain information about fluids in the formation.

These openhole measurements of the formation properties, which may be considered static, because there is no formation fluid movement, may be used to infer the dynamic properties of the formation when the well is produced. When the well is produced, the pressure in the wellbore is less than the reservoir pressure. This condition may be achieved while drilling by way of a new technique called Under Balanced Drilling, or UBD. In this case the well is being drilled and produced simultaneously, so in this measurements of the fluid in the wellbore may contain information about the fluids which are being produced from the formation.

When drilling underbalanced, large quantities of drilling fluids are pumped through the drill string into the wellbore while the wellbore is being drilled. The drilling fluids help cool the cutting surfaces of the drill bits and help carry out the earth cuttings from the bottom of the wellbore when they flow up the annulus to the surface. To ensure that formation fluids flow into the wellbore during this underbalanced drilling process, the drilling fluids are pumped under a pressure that is slightly lower than the expected formation pressure. The lower hydraulic pressure of the drilling fluids may result in a substantial gain of fluid into the wellbore from the formation when a permeable and high pressure zone of the earth formation is encountered. Detection of such fluid production may be used to evaluate the inflow potential of the well, and to modify this inflow by making corresponding changes to the completion of the well. Cumulative fluid flow production from the formation may be detected on the surface. However, for determining the precise depth of each individual contribution to this fluid production, a means of detecting volumetric flows in the wellbore annulus near the drill bit as the well is being drilled is desirable.

Time-of-flight measurement of activated slugs of fluid have been used in the prior art in connection with the Water Flow Log (WFL). In the WFL service, a slim tool is lowered into a producing well, a slug of wellbore fluid is activated and then timed over a relatively long duration to determine the flow rate. In this process, an activation source such as a Pulse Neutron Genrator (PNG) is normally off, and is activated only very briefly to periodically tag a slug of fluid with a neutron burst.

It would be desirable to have methods and apparatus in connection to underbalanced drilling for determining various parameters at a given depth in the wellbore. It is particularly desirable to determine the depth of water producing fractures which are not discernable from resistivity logs. By determining these depths, one may design adequate completion in order to block the flow of undesirable water, for example by altering the producing pipe that is later installed in the well.

SUMMARY OF INVENTION

A method for determining a downhole parameter in an underbalanced drilling environment in accordance with embodiments of the invention includes: selectively activating a first fluid flowing from the formation through a wellbore while under balanced drilled; detecting the activated first fluid, and determining a depth at which said fluid enters the wellbore.

A tool for determining a downhole parameter in a drilling environment is a tool adapted to be placed in a drill string, wherein the tool has an activation device (6) and a gamma ray detector (7) separated along a drill string axis thereof by a distance d. The tool further includes: control circuitry operable to turn on the activation device (6) to selectively activate a first fluid flowing from the formation past the tool; and processing means (17), responsive to the gamma ray detector (7), for determining when the activated slug of first fluid flows past the gamma ray detector (7), and for determining a depth at which said first fluid is detected. Other aspects and advantages of the invention will be apparent from the following description and the appended claims.

DETAILED DESCRIPTION

Embodiments of the present invention rely on the activation of oxygen in the fluid flowing up the well to surface in the annulus between a wellbore and drilling tool. In the activation process, oxygen atoms in the produced fluid are transformed from stable atoms into radioactive atoms by the bombardment with high-energy neutrons. When an oxygen-16 atom is hit by a neutron, a proton can be released out of the nucleus while the neutron is absorbed and a radioactive nitrogen-16 atom is produced. Nitrogen-16, with a half-life of about 7.1 seconds, decays to oxygen-16 by emitting a beta particle. The oxygen-16 that results from the beta decay of nitrogen-16 is in an excited state, and it releases the excitation energy by gamma ray emission. The gamma ray emission may be detected by a gamma ray detector.

Figure 1:
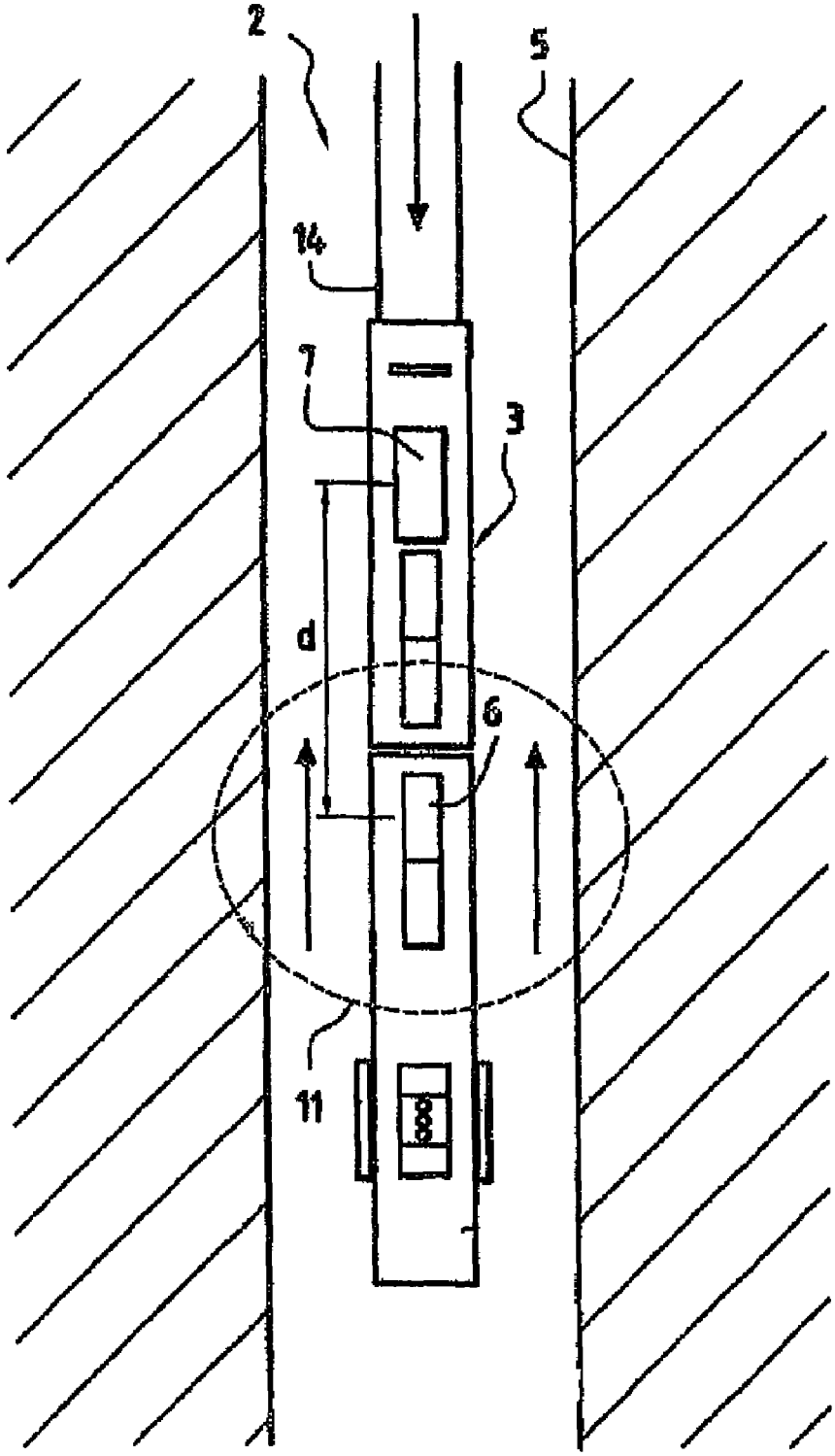
FIG. 1 shows an LWD tool in accordance with one embodiment of the invention.

FIG. 1 shows one embodiment of a formation evaluation tool, such as an LWD tool 3 in a wellbore 2. The LWD tool is part of the drill string 14. The LWD toot 3 includes, among other devices, an activation device, which in one embodiment is a PNG 6 and a an activation detector, which in one embodiment is a gamma ray detector 7 that are spaced apart by a known distance d. The PNG 6 has an activation zone 11, within which atoms are activated by the neutrons emitted from the PNG 6. Oxygen in the fluid is activated, as drilling fluid containing water produced from the formation flows upward (as indicated by the arrows) in the annulus between the LWD tool 3 and the wellbore wall 5, and passes through the activation zone 11. When the activated fluid passes near the gamma ray detector 7, the gamma rays emitted by the activated oxygen are detected. When this activated fluid reaches the gamma ray detector 7, an increase in the gamma ray count rate is detected. The time between when the PNG 6 is pulsed on and the detection of the increase in the gamma ray count rate reflects the time for the activated fluid to travel from the PNG 6 to the gamma ray detector 7. This time is hereinafter referred to as the "time-of-flight."

The distance d between the PNG 6 and the gamma ray detector 7 may be selected to optimize detection of the activated slug. If the distance d is too short, then the detector receives a very large contribution from activated oxygen in the formation, as most minerals found in earth formations contain a significant amount of oxygen. Although this is measurable and repeatable, the statistical variation in the count may make the measurement less accurate. On the other hand, if the distance d is too large, then too much time elapses between when the PNG is pulsed off and when the activated fluid is detected, thus making the detection unreliable. In general, the distance d may be chosen so that for normal flow velocities, d is less than the distance traveled by fluid in the annulus in about 30 seconds.

The gamma ray detector 7 may be any conventional detector used in a neutron/gamma ray tool. In this case, the energy windows of the gamma ray detector 7 are set such that gamma rays emitted by activated oxygen are detected. Alternatively, the gamma ray detector 7 may be a specific detector for the gamma ray emitted by the activated oxygen. The fluid velocity in the annulus may be calculated using the time-of-flight and the known distance d between the PNG 6 and the gamma ray detector 7. Equation 1 shows one formula for calculating the fluid velocity:

$$V_m = \frac{d}{t} \tag{1}$$

where d is the distance between the PNG 6 and the gamma ray detector 7, t is the time-of-flight, and $V_m$ is the velocity of the fluid. The fluid velocity may then be used to compute other downhole parameters such as the fluid volumetric flow rate.

Figure 2:
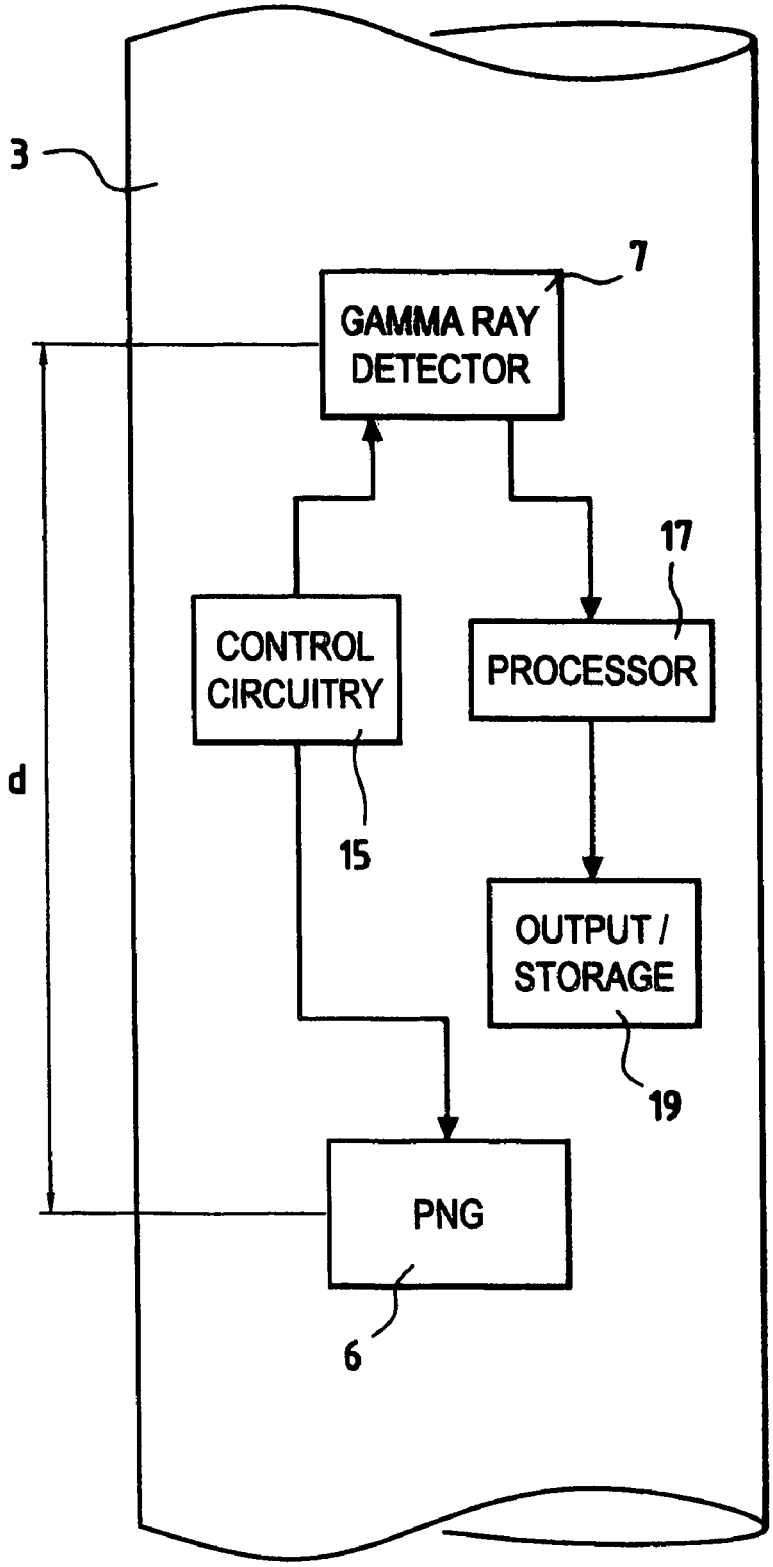
FIG. 2 shows a schematic diagram of circuitry of an LWD tool in accordance with an embodiment of the invention

FIG. 2 shows a schematic representation of a portion of a formation evaluation tool, such as the LWD tool 3 of FIG. 1. As noted previously, the LWD tool includes a PNG 6 and a gamma ray detector 7 separated by a known distance "d". In a given commercial implementation of an LWD tool, the tool may include a variety of circuitry, in addition to various other emitters and sensors, depending on the design of the tool. The precise design of, for example, the control and processing circuitry of the LWD tool is not germane to this invention, and thus is not described in detail here. However, at a minimum, it should be understood that the LWD tool 3 will include control circuitry 15 configured to activate and deactivate the PNG 6 at desired times. In addition, as shown in this example, the control circuitry 15 may also control the gamma ray detector 7.

The output of the gamma ray detector 7 is applied to processing circuitry, which for purposes of this example is shown simply as processor 17. The processor 17 may perform, for example, the calculation of fluid velocity as set forth in equation (1) above. In addition, the processor 17 may perform various other calculations as set forth in the embodiments below. One of ordinary skill in the art will recognize that the processor 17 may be dedicated to the functionality of this invention or, more likely, may be a processor of general functionality to the tool.

Once the processor 17 has completed a desired computation, the processor outputs the result to either a storage medium (for later retrieval) or an output device (for transmission to the surface via a communication channel). Various types of and configurations for such devices exist and are known to those skilled in the art. For the purposes of this explanation, these devices are shown generically as output/storage 19.

Figure 3:
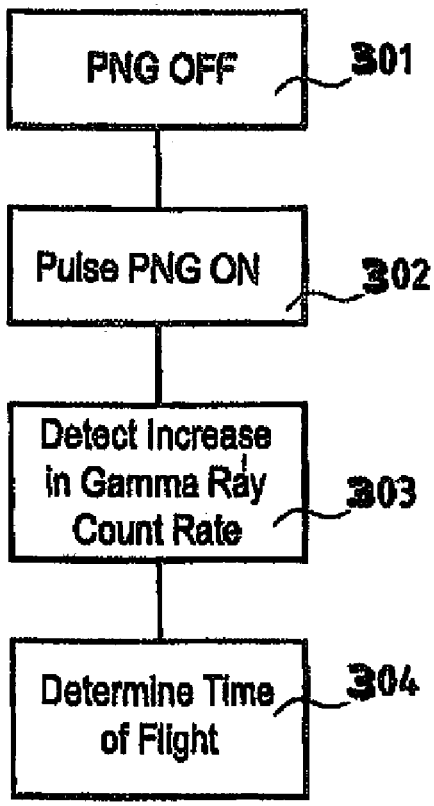
FIG. 3 shows a flow chart of an embodiment of a method of the invention for determining a time-of-flight and FIG. 4 shows a flow chart of an embodiment of a method of the present invention for determining a depth at which the water is found in a formation that is underbalanced drilled.

FIG. 3 is a flow chart illustrating the embodiment of the invention, described above, for determining the time-of-flight of fluid in a drilling environment. First, shown at step 301, the PNG is not operating, i.e., is in a normally "off" state. Next, in step 302, the PNG is pulsed on for a period of time sufficient to allow a slug of fluid to flow through the activation zone (11 in FIG. 1) while the PNG is on. The duration of the on pulse is selected such that the size of the activated slug is sufficient to cause a detectable increase in the gamma ray count rate at the gamma ray detector. In step 303, the increase in the gamma ray count rate is detected at a known distance from the PNG. As noted above, this may be performed using any gamma ray detector known in the art or a detector specific for the gamma rays emitted by the activated oxygen. Then, in step 304, the time-of-flight for the activated slug to travel from the PNG to the gamma detector is calculated.

Different parameters may be determined in accordance with various embodiments of the invention. First, as explained in detail above, the PNG is used to mark a slug of fluid, and the time (time-of-flight) until the marked slug is detected by the gamma ray sensor is measured. The time-of-flight may then be used to determine other parameters of interest. In one embodiment, given the known distance "d" between the PNG and the gamma ray detector equation (1) above may be used to determine fluid slug velocity.

Some LWD tools may include sensors designed to directly measure the diameter of a wellbore during the drilling process. One example of such a sensor is an ultrasonic sensor that determines the diameter of the wellbore by measuring the time it takes an ultrasonic pulse to travel through the mud from the LWD tool, reflect off the wellbore wall, and return to the LWD tool as disclosed in the EPA 02293279.2 METHODS AND APPARATUS FOR ULTRASOUND VELOCITY MEASUREMENTS IN DRILLING FLUIDS. (Roger Griffiths et al). If such a sensor is included in an LWD tool, the wellbore volume over the distance "d" may be calculated from the diameter. An embodiment of the invention may then be used to make a downhole measurement of the volumetric flow rate of the fluid in the annulus, considering there is one fluid in the annulus. If the water is being produced at a rate much higher than the rate of drilling fluid, then this approximation of mono phase flow is reasonable. Specifically, assuming the wellbore volume is known over the distance "d", that the tool volume is known, and that the ROP is either known or negligibly small with respect to the distance "d", from Equation 2 one may determine the volumetric flow rate of the fluid, as shown in Equation $$Q_{dh} = \frac{V_{bh} - V_{tool}}{t} \tag{2}$$

where t is the time-of-flight, $V_{bh}$ is the volume of the wellbore over the distance "d", $V_{tool}$ is the volume of the LWD tool over the distance "d", and $Q_{dh}$ is the volumetric flow rate of the fluid in the region between the PNG and the gamma ray detector. Although the cumulative volumetric flow rate of the fluid is known at the surface, the sub-surface measurement is useful as it provides a precise measure of the depth of water entry into the wellbore. The above-described equations assume that the rate-of-penetration (ROP) of the drill bit is negligible compared to the distance "d". In most circumstances, this assumption will provide good results. Nonetheless, as noted above, the methods of the invention may be adapted to take into account the rate-of-penetration of the drill bit in those cases where it cannot be ignored.

The ROP may be accounted for by reducing the distance between the PNG and the gamma ray detector by the distance traveled by the drill string during the time-of-flight measurement. The distance traveled by the drill string is equal to the ROP times the time-of-flight. Thus, equation 1 can be rewritten to account for the ROP:

$$V_m = \frac{d - (ROP \cdot t)}{t} \tag{3}$$

where ROP is the rate of penetration, d is the distance between the PNG and the gamma ray detector, t is the time-of-flight, and $V_m$ is the fluid flow velocity. Likewise, Equations 1-2 may be adapted to account for the ROP by replacing d with the distance d−(ROP×t).

The LWD tool illustrated in connection with FIGS. 1 and 2 may be used to determine, while drilling, the depths of water producing zones that may exist in the formation adjacent the well being drilled. As it is well known, when a drilling fluid is introduced into the downhole region, the weight of the drilling fluid creates a hydrostatic pressure proportional to its density. The deeper the well, the greater the hydrostatic head pressure developed by the column of drilling fluid. The formation pressure of the reservoir (i.e. the pressure exerted by the gas and/or oil) varies throughout the downhole region. When the formation pressure is equal to the hydrostatic pressure of the drilling fluid, the fluid system is said to be balanced. If the formation pressure is less than the hydrostatic pressure of the drilling fluid, the system is overbalanced. Conversely, a greater formation pressure than the hydrostatic pressure of the drilling fluid results in an underbalanced system. The density of the drilling mud often is reduced to generate under balanced drilling conditions by using an inert gas, typically a nitrogen rich gas, in the drilling fluid. In an under balanced system, the formation pressure causes a net flow of gas and/or oil, and/or water into the wellbore.

In the embodiment of the present invention described herein, the drilling fluid is selected such that it contains little or, if possible, no oxygen. Also, conditions are applied that make the drilling fluid to under balance the formation pressure. For example, the drilling fluid may include oil, hydrocarbon gas, or nitrogen and it substantially under balances the formation pressure. When the well bore is under balanced, it produces fluids from the formation as it is being drilled, just like a producing well. The produced fluids, and the drilling fluids injected down the drill string, flow up the annulus of the drilled well bore past the drilling tool.

While during normal logging operation, the PNG 6 in the LWD tool 3 is "on" most of the time to generate neutrons for the neutron log measurements, in the embodiment of the present invention described herein, the PNG stays "off" most of the time. In accordance with this embodiment of the invention, the PNG is pulsed on for a period of time long enough to enable a specific fluid flowing up through the annulus to become marked (activated). The embodiment of the present invention is directed to selectively mark (activating) the specific fluid flowing from the formation into the wellbore up the annulus. Accordingly, while the specific fluid becomes activated, the accompanying fluids (drilling fluids and hydrocarbons, where the last are present in the formation) do not become activated, and if they so do, it is only to an extent that makes the specific fluid to be detected discernible vis-à-vis the accompanying fluids. As used herein, an "activated fluid" means a slug of fluid that passes through the activation region near the PNG while the PNG is pulsed on and that has a substantially higher radioactivity than un-activated fluid (drilling fluids), such that an increase in gamma rays due to activation of the fluid may be easily detected by the gamma ray detector.

In one embodiment, the specific fluid is water. If water is present in the wellbore annulus, the oxygen in the water is activated by the pulse from the PNG. The gamma ray detector 7 detects activation of the water as an increase in the count rate when the activated fluid (water) passes the detector. As the drilling fluids are selected to contain little or no oxygen, detection of gamma rays by detector 7, in response to a PNG pulsed on, may be properly associated with the presence of water in the wellbore annulus. While the selective activation is performed using drilling fluids that include no or little oxygen, the present invention is not limited to this embodiment. Persons skilled in the art should appreciate that one may design drilling systems where it may be possible to use drilling fluids other than those mentioned above. Such fluids may be differentiated from the specific fluid to be detected (water, in one embodiment) in that the mark (activation) of the specific fluid to be detected is produced selectively so that the mark distinguishes it from the drilling fluids used. Moreover, one may distinguish the presence of the specific fluid to be detected from the presence of other fluids or elements that may get activated by looking at another characteristic of the mark that makes it distinguishable. For example, in the case of oxygen in the water from the formation, its presence may be distinguished from other elements present in the drilling fluids, such as Si, and/or Ba, which also get activated, or from natural gamma rays, in that oxygen gamma rays are at a higher energy than gamma rays from activation of Si and/or Ba or than natural gamma rays. Furthermore, while even a oil-based drilling fluid may still contain some oxygen, the presence of the specific fluid from the formation in the wellbore may still be detected from the presence of the drilling fluid by looking at a sharp increase in the signal detected which shows that something other than the drilling fluid is suddenly present in the wellbore.

Figure 4:
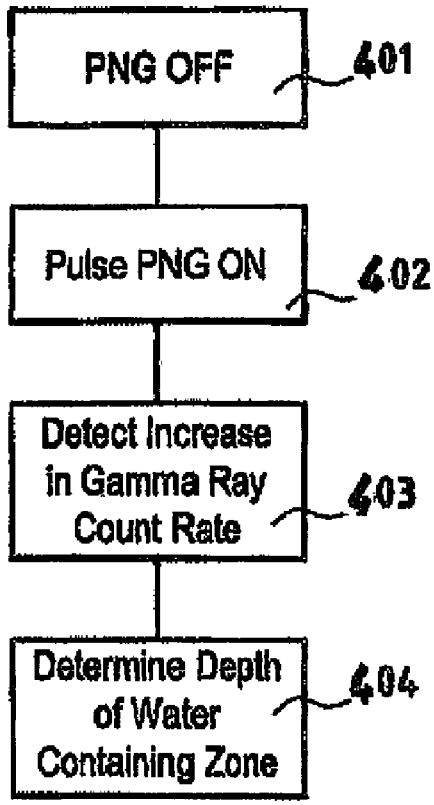

FIG. 4 is a flow chart illustrating the embodiment of the invention, described herein, for determining the depth of a specific fluid (water) containing zone in an earth formation. First, at step 401, the PNG is not operating, i.e., is in a normally "off" state. Next, at step 402, the PNG is pulsed on for a period of time sufficient to allow a slug of fluid containing the specific fluid to flow through the activation zone (11 in FIG. 1) while the PNG is on and to selectively activate the specific fluid, such as water in one embodiment. The pulsing mode of the PNG may be changed by a down command to the tool. The duration of the on pulse is selected such that the size of the activated slug is sufficient to cause a detectable increase in the gamma ray count rate at the gamma ray detector. At step 403, the increase in the gamma ray count rate is detected at a known distance from the PNG. As noted above, this may be performed using any gamma ray detector known in the art or a detector specific for the gamma rays emitted by the activated oxygen. Then, at step 404, it is determined the relative velocity of the specific fluid by looking at the time t at which the count at the gamma ray detector substantially increased. A correction may be made to the actual velocity for the movement of the drill pipe which occurred during the measurement. Note, that while in the method explained in connection with FIG. 4 the PNG is turned off for a period of time and then back on, detection of the fluid in the formation may also be performed in one embodiment without turning the PNG initially off but simply by measuring a sharp increase in gamma ray at the detector which would occur if water would start flowing from the formation in the wellbore.

The formation depth from where this fluid entered the wellbore may be determined knowing the distance from the PNG-detector midpoint to the bit, the rate of bit penetration, and the fluid velocity in the annulus. The distance from the surface to the drill bit is typically determined by standard measurements of the drill pipe depth. When using static real-time logging while drilling measurements, the distance to the drilling tool (bit) from the measurement sensor represents a "blind" interval of wellbore that is penetrated before any information is available about that formation. It is important to reduce the length of this blind zone to avoid drilling a length of formation which may produce unwanted fluids. The dynamic measure of produced fluids while drilling underbalanced substantially reduces this blind interval because the annular fluid flow is much faster than the rate of bit penetration. As the bit penetrates new formation, the fluid from this formation flows up the annulus of the freshly drilled bore past the PNG-detector measure point in the drilling tool. This fluid generally flows at a speed which is several orders of magnitude faster than the drilling rate. Therefore the fluid produced from freshly drilled formation reaches the PNG-detector sensor before the PNG-detector sensor physically passes this formation. Therefore, the point at which the depth of the fluid in the formation may be measured is almost at the bit, even if the physical distance of the bit to PNG-detector is relatively long. The quicker water gets detected, the easier is to take an adequate measure in response, for example terminating drilling.

In another embodiment, the present invention provides a method for determining the flow rate of the specific fluid (water in one example) present in the formation when, the annulus having significant volumes of drilling fluid present as well as formation water, the approximation of mono phase flow may not be used. In this case an additional measurement is performed to account for the reduced proportion of annular flow area contributing to water flow. This method relies on the magnitude of the increase in gamma ray counts measured by the detector as well as the time of flight. The embodiment of the method of calculating the flow rate relies on the method disclosed in the U.S. Pat. No. 5,219,518 (the '518 patent) (MCKeon et al) assigned to the assignee of the present application and hereby incorporated by reference and. The '518 patent discloses at column 13, line 53-column 15, line 13 a first embodiment, where it is shown the flow rate "Q" is proportional to the number of counts detected at the detector. Q is determined by the formula:

$$Q=F(V, d, rd, Ld, Tact, Bhod)\times Cflow/Stotal$$

where "Cflow" is the number of counts in the characteristic that is representative of the flow, "Stotal" is the total number of neutrons emitted during the irradiating period, V and d have been defined above, "rd" is the radius of the detector, "Ld" is the length of the detector, "Tact" is the irradiation period, "Bhod" includes wellbore compensation factors. The function "F" may be determined in a laboratory, by measuring the response of the logging tool upon different environmental conditions. "Cflow" may be determined as the area of the characteristic which is representative of the flow, such as the peak shown on FIGS. 2A, 2B, 3A, 3B, of the '518 patent or the elongated zone 700, 701, 702 on FIGS. 7A, 7B, 7C of the '518 patent. "Area" means the area of the characteristic delimited by the exponential decay curve. In the example of FIGS. 5A, 5B and 6, of the '518 patent, the "Cflow" area corresponds to the respective hatched zones referred to as FLOWING, while in the example of FIGS. 4A, 4B of the '518 patent, the "C flow" area corresponds to the respective hatched zones. "Stotal" can be calculated by any known method, either in a laboratory setup, or in situ during the measurement in the well. By way of example, the method described in U.S. Pat. No. 4,760,252 assigned to Schlumberger Technology Corporation, might be suitable. According to a second embodiment of the '518 patent especially suitable but not exclusively to flow having low velocity, the flow rate "Q" may be determined through the steps described in relation to FIGS. 7A, 7B, 7C and FIG. 8 of the '518 patent. FIG. 8 of the '518 patent shows a plot of counts representative of the flow, versus flow rate (measured in barrel per day; 100 barrels are sensibly equivalent to 15.9 m3). The plot of FIG. 8 of the '518 patent is a reference plot made prior to measurements, either by using a laboratory setup or by modeling calculations. According to the invention disclosed in the '518 patent, it has been discovered that, at least for the low velocities, the counts (representative of the flow) are linearly related to the flow rate. Once an actual plot of count rates versus time (as measured) has been obtained, the area of the characteristic representative of the flow on said actual plot is then calculated, giving an actual number of counts representative of the flow. The actual flow rate is then determined by looking on the reference plot of FIG. 8 of the '518 patent, for the flow rate value corresponding to said actual number of counts.

The fluid flowing in the annulus generally contains a combination of drilling fluid and produced fluid. In one embodiment, the drilling fluid includes oil, and the fluid measured is the produced water. When the produced water rate is not much greater than the oil drilling fluid, the mixture of oil and water in the annulus may be treated as a two-phase flow. One approach to this is using the previously described magnitude of increased counts in addition to the time of flight to determine the water flow rate. Another approach to determine the water flow rate is to make a separate measure of mean water volume fraction ("holdup"), which is then combined with the water velocity and annular flow area according to the equation $$q_w=H_w v_w A \tag{4}$$

where $q_w$ is the water flow rate, $H_w$ is the water holdup, $v_w$ is the water velocity, and A is the annulus flow area.

The water holdup is the proportion of water in the annulus flow area. The water holdup measurement is made as close as possible in time and place as the water velocity measurement. Two methods of determining the water flow rate based on the different measures of water holdup are described hereinafter.

In one embodiment, the present invention provides a method of measuring the flow rate of produced oil and water by way of determining the water velocity (as described above) and the water holdup from the resistivity in the wellbore annulus for an underbalanced well. The well is drilled using a fluid such as the one mentioned above, which contains no or little oxygen relatively to the oxygen contained in water. The determination of the water velocity and of the resistivity of the wellbore fluid is performed at substantially the same time and substantially the same depth in the wellbore. This is carried out by way of a LWD tool including a "nuclear"section, such as a PNG, and a "resistivity" section having measure points close to each other. To determine the resistivity of the wellbore one may revert the method described in the U.S. Pat. No. 4,916,400 (the "Best patent") assigned to Schlumberger Technology Corporation and incorporated herewith by reference. The Best patent relies on knowledge of the resistivity of the fluid in the wellbore to deduce the diameter of the wellbore. The method according to one embodiment of the present invention, uses the diameter of the wellbore, assumed known, to obtain the resistivity of the wellbore.

The Best patent relates to a method and apparatus for measuring the diameter of a wellbore using an electromagnetic tool during wireline logging or logging-while-drilling. An electromagnetic wave is generated at a transmitting antenna located on the circumference of a logging device, and is detected by two or more similar receiving antennas spaced longitudinally from the transmitter. During the operation of such a tool, the transmitted electromagnetic wave travels radially through the wellbore and enters the formation. The wave then travels in the formation parallel to the wellbore wall and then re-enters the wellbore to travel radially to reach the receivers. As a result of this path, the phase of the signal at a receiver (with respect to the phase of the signal at the transmitter) contains information about the wellbore fluid, about the wellbore diameter, and about the formation. The phase shift (and/or attenuation) measured between the receivers depends primarily on the formation resistivity. This phase shift in conjunction with the phase at one or more receivers enables the separation of the effects of the wellbore from the effects of the formation on the phase at a receiver. The wellbore effects are directly related to the wellbore diameter and the resistivity of the fluid in the wellbore.

According to the method of the present invention the diameter of the wellbore may be determined separately by way of a different measurement such as the ultrasonic measurement disclosed in the above-cited European patent application. From knowledge of the diameter, one of the formulae set forth in the Best patent at columns 3-6 may be used to determine the resistivity of the wellbore. The Best patent sets forth at columns 3-6 several ways for determining the diameter of the wellbore as a function of the resistivity of the fluid in the wellbore. For example the Best patent sets forth the following equation:

$$\Phi_T \approx (A-43/R_m+0.47/R_m^2)+(4+5.5/R_m-0.05/-R_m^2)D_h+(17.6+0.14D_h-0.029D_h^2)\Delta\Phi \quad (5)$$

where $\Phi_T$ is the total phase, A is a constant related to the phase of the signal at the transmitting antenna, $R_m$ is the resistivity of the drilling mud, $D_h$ is the diameter of the wellbore, $\Delta\Phi$ is a phase shift between two receivers mounted on the tool, and $\Phi_T$ is the "total phase", ie, twice the sum of the of the phases of the received signals at the two receivers. The Best patent at column 6 explains how this formula may be arrived at, though the embodiment of the present invention described herein is not limited to this expression and to the determination of the resistivity from this expression.

From the resistivity of the wellbore one may obtain the holdup $H_w$, of the produced water in the multiphase fluid assuming that the drilling fluid and the oil have similar dielectric properties, which is a viable assumption in the embodiment discussed herein where the drilling fluid includes oil, hydrocarbon gas, or nitrogen Also one assumes that the amount of gas in the mixture is low enough to consider the mixture a two-phase flow mixture. Moreover, assuming the water volume fraction to be superior to 0.5, the mixture may be consider a water-continuous phase In this case one may use Ramu & Rao formula and the conductivity of the mixture may be expressed as:

$$\sigma_m^w = \sigma_{water}\frac{2\beta}{3-\beta}, \quad (6)$$

and $$\sigma_m = 1/R_m \text{ (taking into account a conversion factor for units)} \quad (7)$$

where β is the holdup $H_w$ (water cut where there is no slippage), and $\sigma_{water}$ is the conductivity of the water.

As $R_m$ may be determined from the Best equations, mentioned above and in the Best patent, $H_w$ may be determined from equation (6). $H_w$ then may be used to derive the water $q_w$ and oil $q_o$ flow rates.

As it is well known, water and hydrocarbon flow rates in homogeneous flows in a well, may be expressed as:

$$q_w = AH_w v_w \quad [8]$$

for the water; and $$q_o = A(1-H_w)v_o \quad [9]$$

for the hydrocarbon, where A is the section of the well, $H_w$ is the mean water volume fraction, $v_w$ is the mean water velocity and $v_o$ is the mean hydrocarbon velocity. One could assume that in the drilling environment there is no slippage velocity between the oil and water phases flowing in the annulus between the wellbore and drill collar. This is a reasonable assumption in the turbulent mixed flow regime of an annulus in the presence of a relatively large drill collar rotating at a high speed, for example a 6¾-in drillstring rotating at 200 rpm with nearly full gauge stabilizers in a 8½ in hole. In this case, the water velocity $v_w$ is approximately equal the oil velocity $v_o$, i.e, the mixture velocity. Therefore, the produced flow rates $q_w$ and $q_o$ may be determined from equations (8) and (9) as the area A is known and the holdup $H_w$ is determined from the resistivity $R_m$ as discussed above Yet in another embodiment, the water holdup may be determined by way of pulsed neutron capture (PNC) logging. (According to this embodiment, the formation which is drilled underbalanced is irradiated by bursts of high energy neutrons (typically 14 MeV). The neutrons are slowed down by collisions with nuclei in the formation and the wellbore. The slow (thermal) neutrons are then, over a period of time, captured by formation and wellbore nuclei (neutron capture) or they diffuse out of the detection range of the detectors (neutron diffusion). The capture of the neutrons is accompanied by the emission of gamma rays, which are detected in the logging tool. The decline of the gamma ray counts with time is primarily a measure of the salinity of the formation fluid and the wellbore fluid. The absence of saline formation water is often an indicator of the presence of hydrocarbons, which do not contain NaCl. The decline of the gamma ray intensity is often reported in terms of a thermal neutron capture cross section σ (sigma) as opposed to a decay time. In general, the presence of hydrocarbons in a formation increases the neutron capture time and therefore decreases sigma.

In one embodiment, the PNC tool may be a "dual-burst" tool, such as the one disclosed in U.S. Pat. No. 4,926,044 THERMAL DECAY TIME LOGGING METHOD AND APPARATUS (Peter Wraight) assigned to Schlumberger Technology Corporation ("Wraight patent"). In a dual-burst tool, a usual "long" neutron burst, from which the formation sigma is determined, is preceded by one or more "short" bursts, which allows the PNC system to characterize and ultimately compensate for the thermal neutron capture effects of the wellbore on the gamma ray counts. The dual-burst timing sequence may begin with a short (for example 10 μs) neutron burst, followed by several (for example five) "capture" count gates, following the burst, during which the fast thermal neutron decay is measured over a time period of several 10 ▯s "Count gates" are prescribed time periods during which signals produced by the gamma ray detectors are delivered to a signal counting circuit (not shown). Because the first burst is relatively short, the formation signal which takes a longer time to build up is small and the resulting gamma ray decay time is related primarily to the wellbore sigma. The timing sequence then may continue with a long (for example, 152 μs) neutron burst, followed by several (for example eight) "capture" count gates over a time of several 100 ▯s during which the "slow" thermal neutron decay is measured. The slow decay is usually dominated by the thermal neutron capture cross section of the formation ▯▯▯▯▯A correction for the influence due to the borehole sigma may be done using the decay time obtained after the short burst(s). Gamma ray counts are accumulated over a predetermined counting period. The gamma ray counts for the counting period then may be used to determine sigma for both the wellbore and the formation as set forth in the Wraight patent. As wellbore capture cross section $\Sigma_{wellbore}$ is a linear combination of $\Sigma_{water}$, the capture cross sections of the water entering the wellbore from the formation, and $\Sigma_{drillingfluid}$, the respective capture cross section of the hydrocarbon drilling fluid, the water holdup $H_w$ may be obtained from the formula below provided that the salinity of the formation water is known.

$$\Sigma_{wellbore}=\Sigma_{water}H_w+\Sigma_{drillingfluid}(1-H_w).$$

This approach is analogous to the resistivity method as the substantial absence of invasion of the formation by drilling fluid involves three variables. In a UBD well the three variables are: wellbore fluid measurement, wellbore size and virgin formation measurement. In typical over balanced well there are five variables: wellbore fluid measurement, wellbore size, invaded zone measurement, invaded zone depth, and virgin formation measurement. Also, both methods utilize a measure of the water salinity, which is possible from surface measurements of a produced water sample. This water salinity determines the Formation Water Sigma term in the Wellbore Sigma equation, and the Formation Water Resistivity term in the Wellbore Resistivity equation.

The embodiments described herein have several applications. One such application, is in those instances when the source of water production may not be determined from other means because static measurements in which no fluid is flowing lack the depth or resolution to reveal the source of water production. As an example in the case of water-producing fractures, one may not be able to determine just from static measurements what type of fluid these fractures would produce. However, when a well is drilled under balanced, the embodiment of the present invention offers the possibility of making measurements under dynamic conditions in which the well is flowing. Several options may be pursued as a water producing zone is intersected. The water producing zone could be abandoned and a better positioned hole could be drilled. Alternatively, the hole with water producing zones could be isolated by installing an adequate completion including water shutoff devices positioned at the appropriate depths. One simple completion offering the shutoff option, is where the casing is cemented but has perforations only in the zones producing hydrocarbons. The embodiments of the present invention described herein may also be used to assess at the drill bit while drilling how much fluid loss is being incurred. This could also be used as a real time monitor to assess the effectiveness of drilling fluid loss treatments, or possibly more permanent treatments down the road. After drilling, with the entire newly drilled wellbore under production, the logging tool may be used to create a water flow log of the entire well while pulling out of the wellbore. This log could be used as a base log to verify the effectiveness of the completion, which would be installed in the well after this initial logging to minimize this water inflow. A second water flow log would be run after the completion with a production logging tool using the same measurement principle. A comparison of the two logs would verify the effectiveness of the water shutoff.

While the embodiments of the present invention described herein have been discussed in connection with underbalanced drilling, the present invention is not so limited to such type of drilling. It may be applicable to overbalanced drilling where upon drilling through a fracture, in order to asses its producibility, the pressure in the well is temporarily lowered, followed by underbalanced drilling as explained above in this description. During the underbalanced drilling, as the well is producing for a short period of time, the measurements discussed above may be performed. Overbalanced operation is then resumed.

While the invention has been described with respect to a limited number of embodiments, those skilled in the art, having benefit of this disclosure, will appreciate that other embodiments can be devised which do not depart from the scope of the invention as disclosed herein. For example, although activation using a PNG has been described for purposes of illustration, any activation device would be usable within the scope of the invention. Accordingly, the scope of the invention should be limited only by the attached claims.

The invention claimed is:

1. A method for determining a downhole parameter in a drilling environment, comprising:

drilling a wellbore overbalanced;

detecting a fracture through the formation;

drilling said wellbore underbalanced;

selectively producing a mark on a first fluid flowing from the formation through said wellbore during under balanced drilled;

detecting the mark in the first fluid;

determining a depth at which said mark was detected in said first fluid; and resuming drilling overbalanced.

* * * * *